US007358905B2

(12) United States Patent
Kasamatsu et al.

(10) Patent No.: US 7,358,905 B2
(45) Date of Patent: Apr. 15, 2008

(54) ANTENNA DEVICE

(75) Inventors: Hideki Kasamatsu, Osaka (JP); Hiroshi Nakashima, Osaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 70 days.

(21) Appl. No.: 10/558,756

(22) PCT Filed: May 28, 2004

(86) PCT No.: PCT/JP2004/007804

§ 371 (c)(1),
(2), (4) Date: Dec. 1, 2005

(87) PCT Pub. No.: WO2004/109846

PCT Pub. Date: Dec. 16, 2004

(65) Prior Publication Data

US 2007/0024507 A1 Feb. 1, 2007

(30) Foreign Application Priority Data

Jun. 2, 2003 (JP) ..... 2003-157068

(51) Int. Cl.
*H01Q 1/24* (2006.01)

(52) U.S. Cl. ..... 343/702

(58) Field of Classification Search ..... 343/702, 343/725–726, 741, 901
See application file for complete search history.

(56) References Cited

U.S. PATENT DOCUMENTS 5,429,363 A * 7/1995 Hayashi ..... 463/40
5,764,194 A * 6/1998 Brown ..... 343/726
2002/0118135 A1* 8/2002 Johnson et al. ..... 343/702
2004/0125043 A1* 7/2004 Kocsi ..... 343/912

FOREIGN PATENT DOCUMENTS

| | | |
|---|---|---|
| JP | 55-8337 | 2/1980 |
| JP | 6-47171 | 2/1994 |
| JP | 9-246824 | 9/1997 |
| JP | 10-26125 | 1/1998 |
| JP | 10-41744 | 2/1998 |
| JP | 11-98046 | 4/1999 |
| JP | 11-220418 | 8/1999 |

(Continued)

OTHER PUBLICATIONS

Japanese Office Action dated Jul. 18, 2006.

*Primary Examiner*—Huedung Mancuso
(74) *Attorney, Agent, or Firm*—Westerman, Hattori, Daniels & Adrian, LLP.

(57) ABSTRACT

In an antenna device of the present invention, a plurality of antennas 21 are connected to a radio module 41 through respective coaxial cables 22, and one or more of the antennas 21 in good communication conditions can be selected by the radio module 41. An upper cabinet 2 is pivoted to a lower cabinet 4 through a three-dimensional joint 3. The radio module 41 is contained in the lower cabinet 4, while the plurality of antennas 21 are contained in the upper cabinet 2. The plurality of coaxial cables 22 extending from the plurality of antennas 21 are tied in a bundle to pass through a through hole 34 provided in the three-dimensional joint 3, and are connected to the radio module 41.

2 Claims, 4 Drawing Sheets

FOREIGN PATENT DOCUMENTS

| | | |
|---|---|---|
| JP | 2002-64328 | 2/2002 |
| JP | 2002-122129 | 4/2002 |
| JP | 2002-237773 | 8/2002 |
| JP | 2002-271116 | 9/2002 |
| JP | 2002-271125 | 9/2002 |

* cited by examiner

ANTENNA DEVICE

This application is the National Phase International Application PCT/JP04/07804 filed May 28, 2004.

TECHNICAL FIELD

The present invention relates to an antenna device that receives radio waves by a diversity method.

BACKGROUND ART

Diversity method antenna devices have been conventionally known that have a plurality of antennas with different reception characteristics and directivities, and select therefrom an antenna in the best communication condition to receive radio waves (see JP 2002-237773, A and JP 2002-271125, A, for example).

In the diversity method antenna devices, the plurality of antennas are connected to a radio module through coaxial cables, and one or more of the antennas in good communication conditions are selected by the radio module. Therefore, good communication condition can be obtained even in the case where reception radio waves vary in arrival direction with surrounding environments or the case where reflected waves or diffracted waves of the radio waves are received.

Alternatively, antenna devices have been known that can obtain good communication condition by varying directions of an antenna (see JP 9-246824, A and JP 6-47171, A).

For example, as shown in FIG. 5, an antenna device described in JP 9-246824, A includes a telescopic antenna 9 slidably projecting from an end of a case 8. A recess 81 is defined at the end of the case 8, and an opening 82 is defined at a bottom of the recess 81. Inside the case 8, a cylindrical antenna holder 83 is attached facing to the opening 82. The antenna 9 has a first rod 911 having the largest diameter among a plurality of telescopic rod portions 91, the first rod 911 coupled to an antenna base 93 through a hinge mechanism 92. The antenna base 93 is slidably held by the antenna holder 83, and can rotate on the sliding direction.

In the antenna device, the antenna 9 can be rotated by the hinge mechanism 92 so as to be close to or apart from the case 8, while the antenna 9 can rotate on a central axis thereof to vary directions of a rotation axis of the hinge mechanism 92. Therefore, the antenna 9 can be directed in a direction of the highest reception sensitivity to thereby obtain good communication condition.

However, in the diversity method antenna devices, although an antenna in the best communication condition can be selected from the plurality of antennas, a direction of the antenna cannot be changed. Therefore, when a directivity of the antenna is out of an arrival direction of radio waves, the best reception condition cannot be obtained.

In the antenna device capable of varying directions of the antenna as shown in FIG. 5, although the antenna can be directed in a direction of the highest reception sensitivity, inherent reception characteristics of the antenna cannot be changed. Therefore, when the reception characteristics of the antenna are inappropriate for reception of intended radio waves, the best reception condition cannot be obtained.

Accordingly, an object of the present invention is to provide an antenna device capable of always realizing the best reception condition regardless of arrival directions of radio waves or inherent reception characteristics of each antenna.

DISCLOSURE OF THE INVENTION

In an antenna device of the present invention, a plurality of antennas 21 are connected to a radio module 41 through respective cables, and one or more of the antennas 21 in good communication conditions can be selected by the radio module 41. A movable case is pivoted to a base case through a three-dimensional joint 3, and the radio module 41 is contained in the base case, while the plurality of antennas 21 are disposed in the movable case. The plurality of cables extending from the plurality of antennas 21 are tied in a bundle to pass through a through hole 34 provided in the three-dimensional joint 3, and are connected to the radio module 41.

In the above-described antenna device of the present invention, the base case may be, for example, a part of a cabinet of a television receiver, or may be a separate cabinet fixed to the cabinet of the television receiver. The three-dimensional joint 3 has freedom around each of three axes orthogonal to each other, and therefore can direct each of the plurality of antennas disposed in the movable case in any direction with the base case fixed by inclining the movable case from front to back and from left to right, or rotating the movable case on a vertical axis.

When radio waves are transmitted or received, one or more of the antennas 21 in good communication conditions are first selected from the plurality of antennas 21 by the radio module 41. Next, in a reception condition of the selected antennas 21, a user varies directions of the antennas 21 while monitoring variations in reception sensitivity, and sets the antennas 21 to a direction of the highest reception sensitivity. Thus, one or more of the antennas 21 in good communication conditions are selected from the plurality of antennas 21, and the best reception condition can be obtained by further directing the antennas 21 in a direction of the highest reception sensitivity.

In a specific construction, the three-dimensional joint 3 includes a pivot portion 31 projecting from one of the base and movable cases, a spherical portion 32 provided on an end of the pivot portion 31, and a sphere receiving portion 43 provided in the other case, to which the spherical portion 32 fits so as to rotate freely. The through hole 34 penetrates through the pivot portion 31 and the spherical portion 32 to open to an inside of the one case and to an inside of the other case.

In the specific construction, the plurality of cables extending from the plurality of antennas in the movable case are tied in a bundle to enter an inside of the through hole 34 from an opening of the pivot portion 31 of the three-dimensional joint 3, pass through the through hole 34, and reach from an opening of the spherical portion 32 to an inside of the base case, and are connected to the radio module 41 in the base case. Therefore, the plurality of cables will vary in posture as the movable case inclines while being tied in a bundle inside the through hole 34 of the pivot portion 31 and the spherical portion 32, and will not be entangled with each other.

As described above, according to the antenna device of the present invention, the best reception condition can always be realized regardless of arrival directions of radio waves or inherent reception characteristics of each antenna.

BEST MODE FOR CARRYING OUT THE INVENTION

An embodiment of the present invention carried out to an antenna device of a television receiver will be specifically described below with reference to the drawings.

Figure 1:
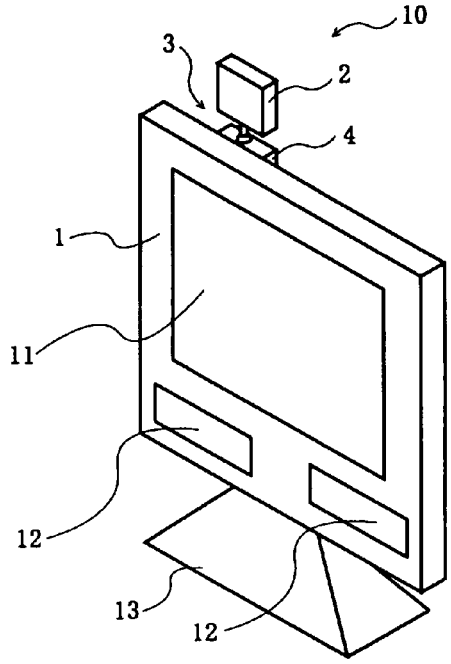
FIG. 1 is a perspective view showing an antenna device of the present invention.

As shown in FIG. 1, the television receiver of the present invention includes a flat main body 1, and the main body 1 is supported by a base 13. A flat display 11 is disposed on a surface of the main body 1, while a pair of speakers 12, 12 are disposed below the display 11. An antenna unit 10 for receiving television broadcast waves is also attached to a back surface of the main body 1.

The television receiver is connected by a wireless LAN with a television broadcast receiving device (not shown) installed indoors, and can output video and audio of television broadcasts from the display 11 and the speakers 12, 12 by receiving television broadcast waves transmitted from the television broadcast receiving device by the antenna unit 10.

Figure 2A:
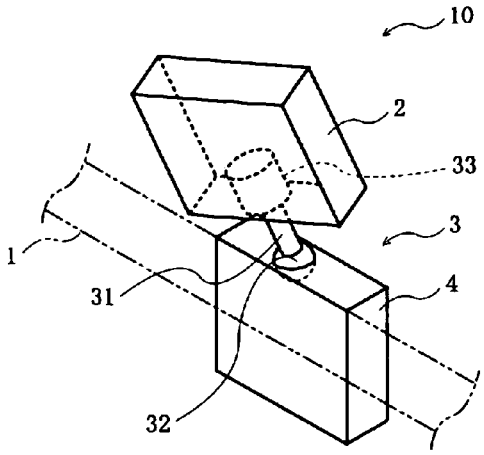
FIG. 2 is a perspective view showing movements of an upper cabinet of an antenna unit in the antenna device.
Figure 2B:
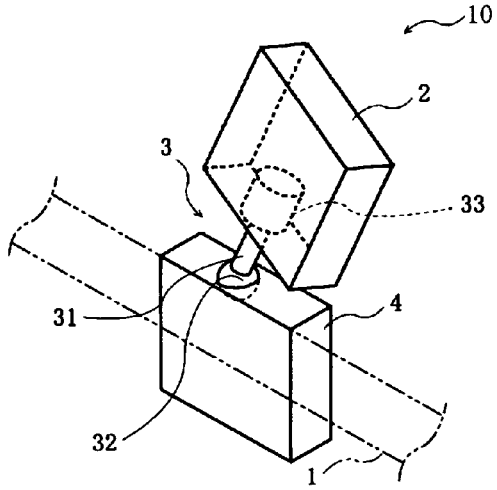

As shown in FIGS. 2(*a*) and (*b*), the antenna unit 10 includes an upper cabinet 2 and a lower cabinet 4 each in the form of rectangular parallelepiped, and the both cabinets 2, 4 are coupled to each other by a three-dimensional joint 3. The upper cabinet 2 is thereby pivoted to the lower cabinet 4. As shown, a user can incline the upper cabinet 2 from front to back and from left to right relative to the lower cabinet 4, and also can rotate the upper cabinet 2 on a vertical axis.

As shown in FIG. 1, the antenna unit 10 is attached to the main body 1 of the television receiver with the lower cabinet 4 fixed to the back surface of the main body 1 and the upper cabinet 2 projecting from an upper surface of the main body 1.

Figure 3:
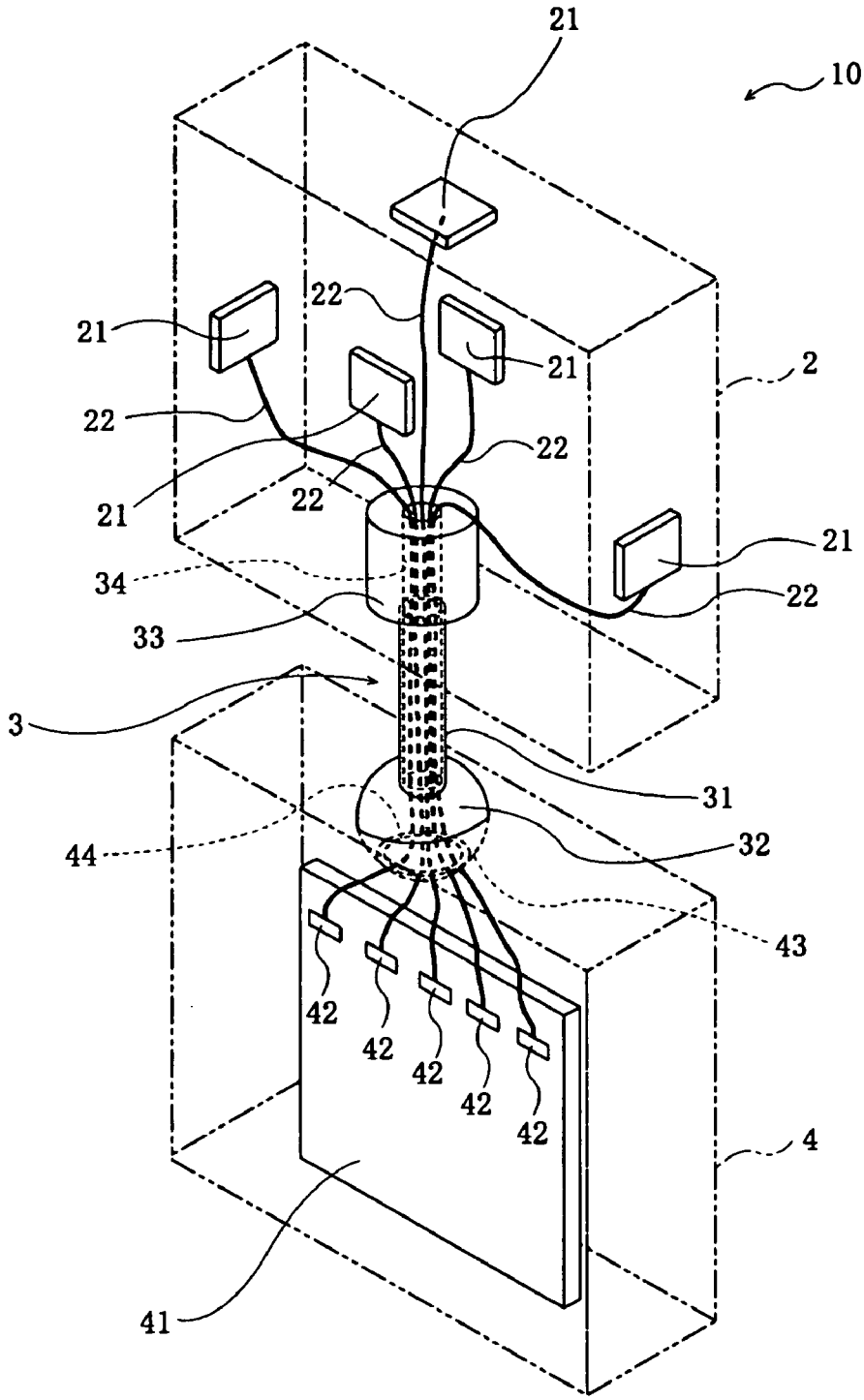
FIG. 3 is a perspective view showing an internal structure of the antenna unit.

As shown in FIG. 3, inside the upper cabinet 2, five flat antennas 21 with different reception characteristics and directivities are attached to five surfaces except a bottom surface. Coaxial cables 22 with excellent high-frequency characteristics are connected to the respective antennas 21.

Figure 4:
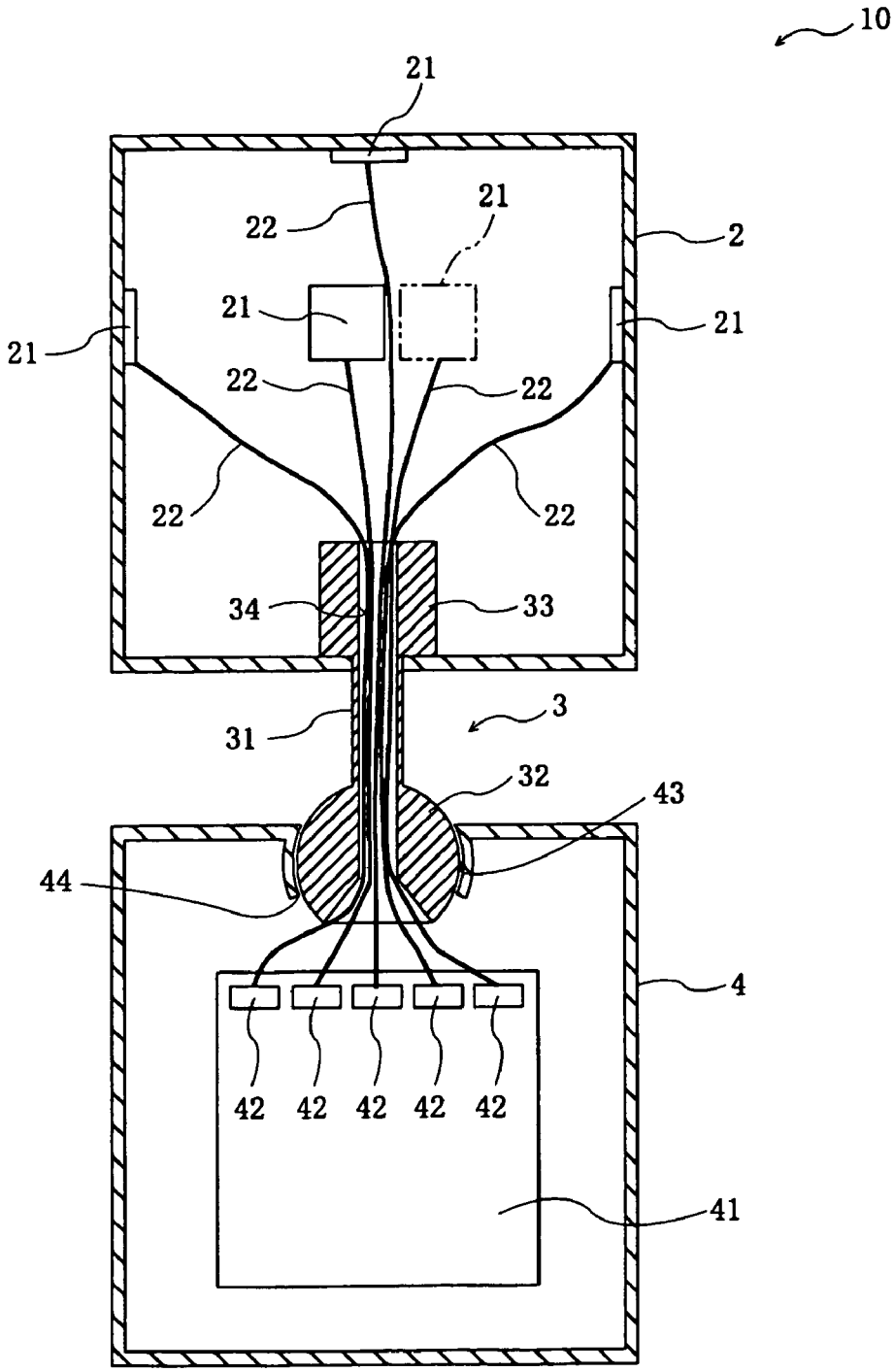
FIG. 4 is a sectional view of the antenna unit.
Figure 5:
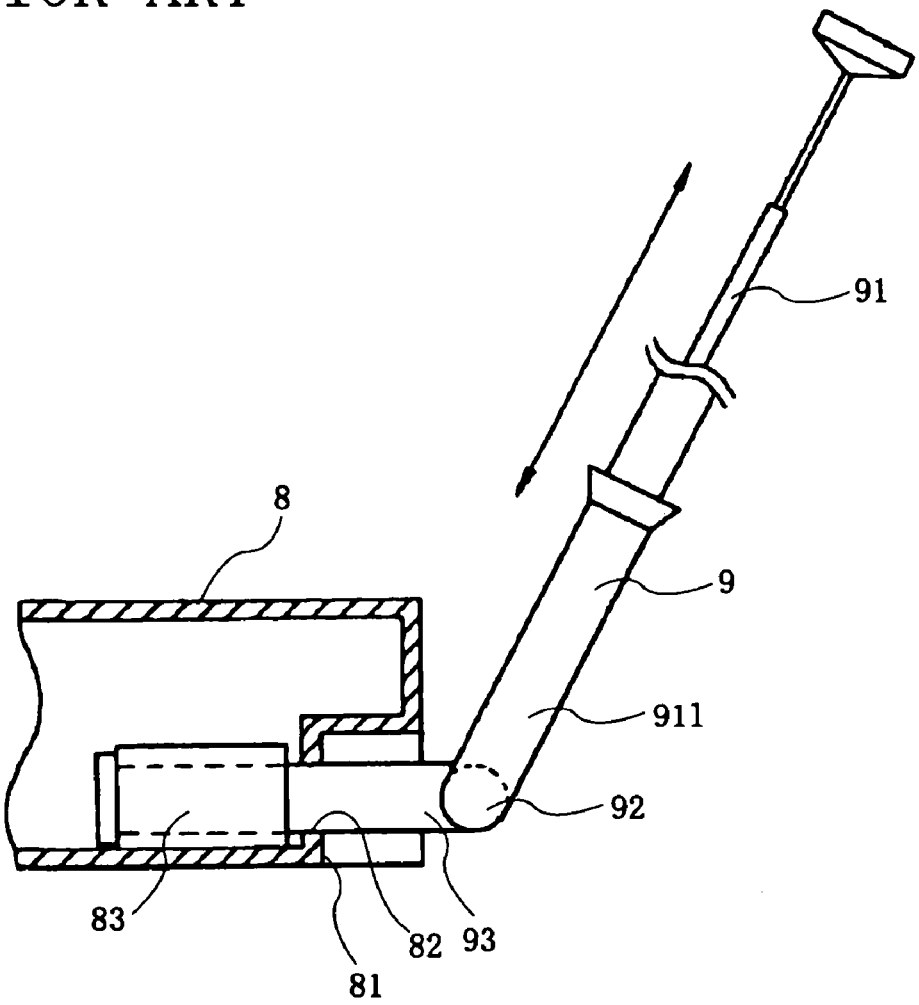
FIG. 5 PRIOR ART
FIG. 5 is a partially broken side view of a conventional antenna device.

As shown in FIG. 3 and FIG. 4, the three-dimensional joint 3 includes a cylindrical pivot portion 31 penetrating the bottom surface of the upper cabinet 2 and attached to the upper cabinet 2, a spherical portion 32 formed on a lower end of the pivot portion 31, and a sphere receiving portion 43 recessed from an upper surface of the lower cabinet 4, to which the spherical portion 32 fits so as to rotate freely. A large-diameter portion 33 is formed on an upper end of the pivot portion 31. A through hole 34 from an upper surface of the large-diameter portion 33 to a bottom of the spherical portion 32 is provided in the pivot portion 31 and the spherical portion 32. An opening of the through hole 34 on the spherical portion 32 has an internal diameter gradually expanding downwardly.

The sphere receiving portion 43 of the lower cabinet 4 defines on a bottom thereof an opening 44 having an internal diameter smaller than a diameter of the spherical portion 32 and larger than a diameter of the opening of the spherical portion 32. The through hole 34 of the three-dimensional joint 3 is thereby opened to an inside of the lower cabinet 4 as well as an inside of the upper cabinet 2. The five coaxial cables 22 extending from the five antennas 21 in the upper cabinet 2 are tied in a bundle to penetrate through the through hole 34 of the three-dimensional joint 3, and reach to the inside of the lower cabinet 4 at ends thereof.

A radio module 41 is disposed inside the lower cabinet 4, and five terminal areas 42 are formed on an upper end of the radio module 41. Ends of the coaxial cables 22 are connected to the respective terminal areas 42. The five antennas 21 are thereby connected to the radio module 41 through the five coaxial cables 22. Each of the coaxial cables 22 extends from the respective antenna 21 to the radio module 41 with an appropriate allowance.

In the above-described antenna device of the present invention, the three-dimensional joint 3 of the antenna unit 10 has freedom around each of two orthogonal axes on a horizontal plane, and therefore can incline the upper cabinet 2 from front to back and from left to right relative to the lower cabinet 4. The three-dimensional joint 3 also has freedom around the pivot portion 31, and therefore can rotate the upper cabinet 2 on the pivot portion 31. The upper cabinet 2 of the antenna unit 10 can be thus directed in any direction relative to the main body 1 of the television receiver, and each of the five antennas 21 contained in the upper cabinet 2 can be thereby directed in any direction.

In the above-described antenna device of the present invention, when television broadcast waves are received from the television broadcast receiving device, one or more of the antennas 21 in good communication conditions are first selected from the five antennas 21 by the radio module 41. Next, in a reception condition of the selected antennas 21, the user varies directions of the upper cabinet 2 while, for example, checking picture quality of the display 11 to determine the direction where the best picture quality is obtained. The antennas 21 are thereby set to a direction of the highest reception sensitivity to realize the best reception condition. Consequently, the display 11 displays high-quality video without noise, while the pair of speakers 12, 12 emit high-quality audio without noise.

In the above-described antenna device of the present invention, the five coaxial cables 22 extending from the five antennas 21 in the upper cabinet 2 are tied in a bundle to enter the inside of the through hole 34 from an opening of the pivot portion 31 of the three-dimensional joint 3, pass through the through hole 34, and reach from the opening of the spherical portion 32 to the inside of the lower cabinet 4, and are connected to the radio module 41 in the lower cabinet 4. Therefore, these five coaxial cables 22 will vary in posture as the upper cabinet 2 varies in posture while being tied in a bundle inside the through hole 34, and will not be entangled with each other.

Each of the coaxial cables 22 extends between the antennas 21 and the radio module 41 with a sufficient allowance. Therefore, variations in direction of the upper cabinet 2 will not produce excessive tension acting on the coaxial cables 22, and are unlikely to break the coaxial cables 22.

According to the above-described display device of the present invention, one or more of the antennas 21 in good communication conditions are selected among the five antennas 21 by the radio module 41. The upper cabinet 2 of the antenna unit 10 is rotated in a communication condition of these antennas 21 to enable the antennas 21 to be directed in a direction of the highest reception sensitivity. Therefore, the best reception condition can always be realized regardless of arrival directions of radio waves or inherent reception characteristics of each antenna.

The present invention is not limited to the foregoing embodiment in construction but can be modified variously within the technical scope set forth in the claims. For example, the same effect as in the foregoing embodiment can be obtained by a construction in which the three-dimensional joint 3 has the pivot portion 31 and the spherical portion 32 projecting from the upper surface of the lower cabinet 4, and the sphere receiving portion 43 recessed from the bottom surface of the upper cabinet 2. The same effect as in the foregoing embodiment can also be obtained by a construction in which the radio module 41 is incorporated in the main body 1 of the television receiver, while the sphere receiving portion 43 of the three-dimensional joint 3 is provided in the main body 1.

The invention claimed is:

1. An antenna device comprising:

a base case including a radio module, a movable case including a plurality of antennas, and a three-dimensional joint attached to said base case and said movable case, wherein a plurality of cables are attached to said plurality of antennas and said radio terminal, and are bundled to pass through a through hole in said three-dimensional joint, and wherein said radio module selects one or more of said plurality of antennas in order to maintain good communication conditions wherein, the three-dimensional joint comprises:

a pivot portion projecting from said movable case, a spherical portion provided on an end of said pivot portion, and a sphere receiving portion provided in said base case, to which said spherical portion fits so as to rotate freely, wherein said through hole penetrates through said pivot portion and said spherical portion to open an inside of said movable case to an inside of the base case.

2. An antenna device comprising:

a base case including a radio module, a movable case including a plurality of antennas, and a three-dimensional joint attached to said base case and said movable case, wherein a plurality of cables are attached to said plurality of antennas and said radio terminal, and are bundled to pass through a through hole in said three-dimensional joint, and wherein said radio module selects one or more of said plurality of antennas in order to maintain good communication conditions wherein, the three-dimensional joint comprises:

a pivot portion projecting from said base case, a spherical portion provided on an end of said pivot portion, and a sphere receiving portion provided in the movable case, to which said spherical portion fits so as to rotate freely, wherein said through hole penetrates through said pivot portion and said spherical portion to open an inside of the base case to an inside of the movable case.

* * * * *